US007114262B2

(12) United States Patent
Andrewes

(10) Patent No.: US 7,114,262 B2
(45) Date of Patent: Oct. 3, 2006

(54) SUNDIAL WITH STANDARD TIME DISPLAY

(76) Inventor: William J. H. Andrewes, 83 Grant St., Concord, MA (US) 01742

( * ) Notice: Subject to any disclaimer, the term of this patent is extended or adjusted under 35 U.S.C. 154(b) by 47 days.

(21) Appl. No.: 11/026,467

(22) Filed: Dec. 30, 2004

(65) Prior Publication Data

US 2005/0155236 A1 Jul. 21, 2005

Related U.S. Application Data

(60) Provisional application No. 60/533,407, filed on Dec. 30, 2003.

(51) Int. Cl.
*G04B 49/02* (2006.01)

(52) U.S. Cl. ..... 33/270

(58) Field of Classification Search ..... 33/268–271
See application file for complete search history.

(56) References Cited

U.S. PATENT DOCUMENTS

| | | | | | |
|---|---|---|---|---|---|
| 2,531,932 | A * | 11/1950 | Brown | ..... | 33/268 |
| 4,028,813 | A * | 6/1977 | Eldridge | ..... | 33/270 |
| 4,081,911 | A * | 4/1978 | Eldridge | ..... | 33/270 |
| 4,924,592 | A * | 5/1990 | Fuller | ..... | 33/270 |
| 5,197,199 | A * | 3/1993 | Shrader | ..... | 33/270 |
| 6,308,427 | B1 * | 10/2001 | Kaufmann | ..... | 33/270 |
| 6,523,270 | B1 * | 2/2003 | Cheung | ..... | 33/270 |

* cited by examiner

*Primary Examiner*—Christopher W. Fulton
(74) *Attorney, Agent, or Firm*—Jerry Cohen

(57) ABSTRACT

A horizontal sundial (1) that can be used to find standard time accurately and be manufactured on a commercial basis for any specific location, incorporating a gnomonic projection map (1M), a wire gnomon (1*a*) to indicate the time on a scale (1*b*), and the point of noon on the map (1*c*), and a bead (1*d*) located directly above the center of the dial for indicating the Sun's overhead position on the map (1*e*), and marking special occasions and special dates.

11 Claims, 13 Drawing Sheets

P = Position of gneomon anchor on dial plate.

E = Location of Equator on map

SUNDIAL WITH STANDARD TIME DISPLAY

FIELD AND BACKGROUND OF THE INVENTION

The present invention relates to sundials. The present invention is a form of horizontal sundial showing standard time and incorporating a gnomonic projection map.

Most horizontal sundials indicate local solar time (a system of time measurement abandoned long ago). It is a principal object of the present invention to provide a sundial that can be used, like a modern clock or watch, to find standard time to the nearest minute.

The present invention meets such object by automating on computer the construction of the circle or other trace showing the time and incorporating this with a gnomonic projection map. A gnomon, preferably made of metal wire (e.g. nitinol or stainless steel), not only indicates by its shadow the time on the hour scale but also marks the point of midday on the map and is further configured by means of a bead on the wire to indicate the place where the Sun is directly overhead. Since the height of the Sun varies with the seasons, the invention can be configured so that the bead's shadow can be used to highlight special dates (anniversaries, birthdays, & etc.) marked on the map between the Tropics of Cancer/Capricorn. Other scientific, commercial (practical) and versatile aspects of the invention are described below.

Although a computerized map-projection program became available in the 1970s for cartographic purposes, due to cost its availability was restricted to universities, corporations, and government institutions. Map-projection software programs (e.g. Geocart introduced in 1993) contributed to cartography but the relevance of the computer modeling of the gnomonic projection to the construction of a sundial has not been recognized or implemented.

It is a principal object of the invention to provide a sundial with standard time display of high accuracy that can be manufactured on a commercially viable basis while allowing customization to any given location on Earth. Further objects are to show where noon occurs and the sun is overhead.

Other objects, features and advantages will be apparent from the following detailed description of preferred embodiments taken in conjunction with the accompanying drawings in which:

DETAILED DESCRIPTION OF PREFERRED EMBODIMENTS

The present invention is explained through an illustrative embodiment 1 (see FIG. 1) showing standard time at a given location where the sundial is to be placed. It incorporates a gnomonic projection map 1M, custom tailored to be centered precisely at the given location (preferably to the nearest few seconds of arc) so that the gnomon such as a wire (1*a*), not only indicates by its shadow the time (1*b*) but also marks the point of midday on the map (1*c*). In such a map any straight line on the map between two points (cities, etc.) follows a great circle of the Earth. The longitude lines are also great circles. The bead on the gnomon (1*d*) indicates the place where the Sun is directly overhead (1*e*). Since the height of the Sun varies with the seasons, the bead's shadow can, furthermore, be used to highlight special dates (anniversaries, birthdays, & etc.) marked on the map between the Tropics (1*f*). When made of polished black igneous rock, this dial, which is set on a North-South axis, can also serve as a form of nephoscope, showing by the reflection of clouds the direction of the wind. Aside from these scientific attributes, the refined proportions of the design of the dial plate combined with the striking contrast between the polished black rock and the gilded elements of the gnomon places the product into the category of the decorative arts, in which it may be appreciated for elegant appearance and fine craftsmanship. There is a longitudinal aspect of the invention. The hour lines are the meridians of longitude on the map. Unlike most horizontal dials that have only to conform to a particular latitude, this instrument must also be adjusted for the longitude of the place that it is made for, so it will indicate standard rather than solar time.

Figure 2:
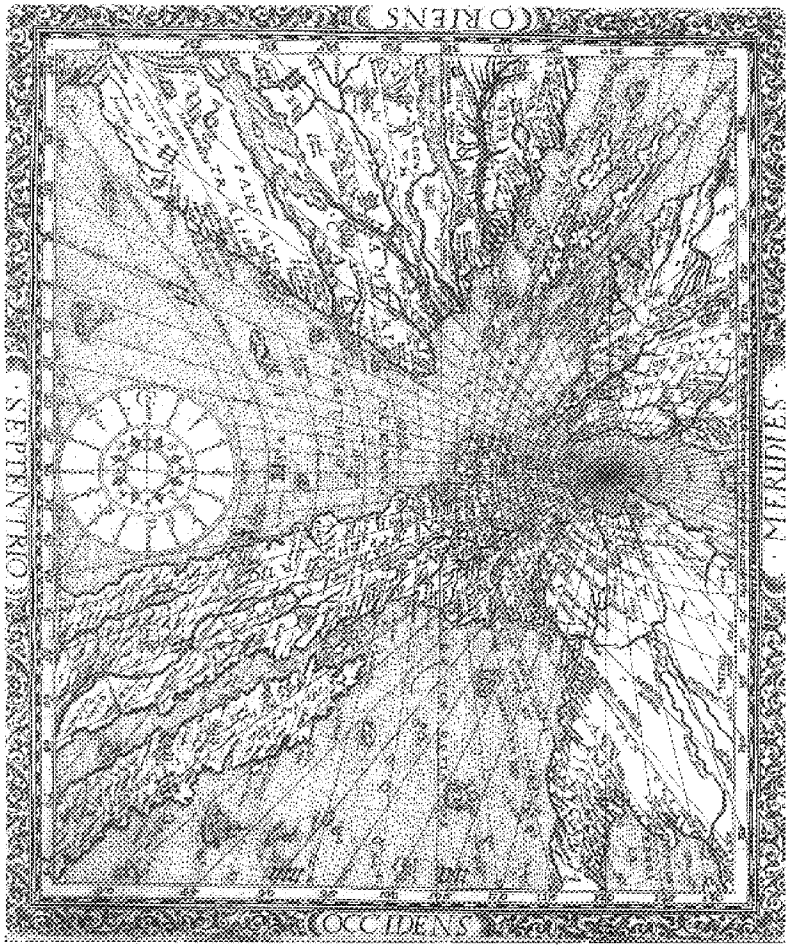
FIG. 2 PRIOR ART
FIG. 2. (prior art) is a copy of a gnomonic projection map, published in *Speculum Solis* (Nuremberg, 1610) by Franz Ritter.

The concept of a horizontal sundial incorporating a gnomonic projection map was first published in 1610 by Hans Ritter in Nuremberg, Germany. This is shown in FIG. 2. There is, however, no evidence that Ritter or anyone else since then ever produced a working example that was commercially viable. One of the likely reasons for this is that a gnomonic projection map is very complicated and too detailed to manufacture under prior art apparatuses. Because the appearance of the map and the position of hour scale are determined by longitude as well as latitude, each dial varies according to the specific location that it is made for.

Figure 3:
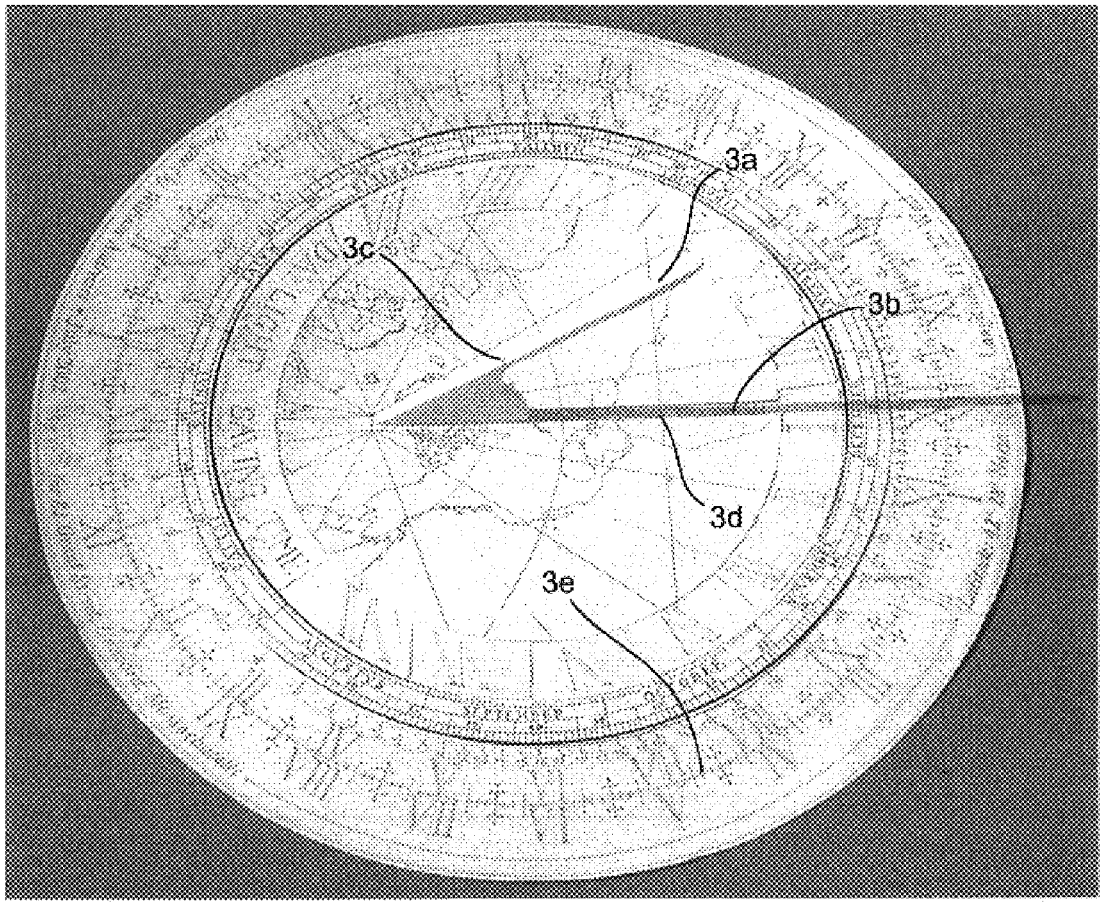
FIG. 3. shows isometrically a further embodiment.

A further embodiment of the present invention is shown in FIG. 3. In this model, the hour scale is split to accommodate the thickness of a traditional form of thick brass gnomon (3*a*) and within this divided line a calendar is inscribed (3*b*): when the Sun crosses the meridian at noon, a small hole in the gnomon (3*c*) allows a pinhole of light to fall on the calendar scale and thereby marks the date (3*d*). The outer circles of this design comprise a lunar volvelle for converting the time found by the shadow of the Moon into solar time (3*e*). These further features may be employed in alternate versions of the presently shown embodiments of the invention and other dials.

Figure 4:
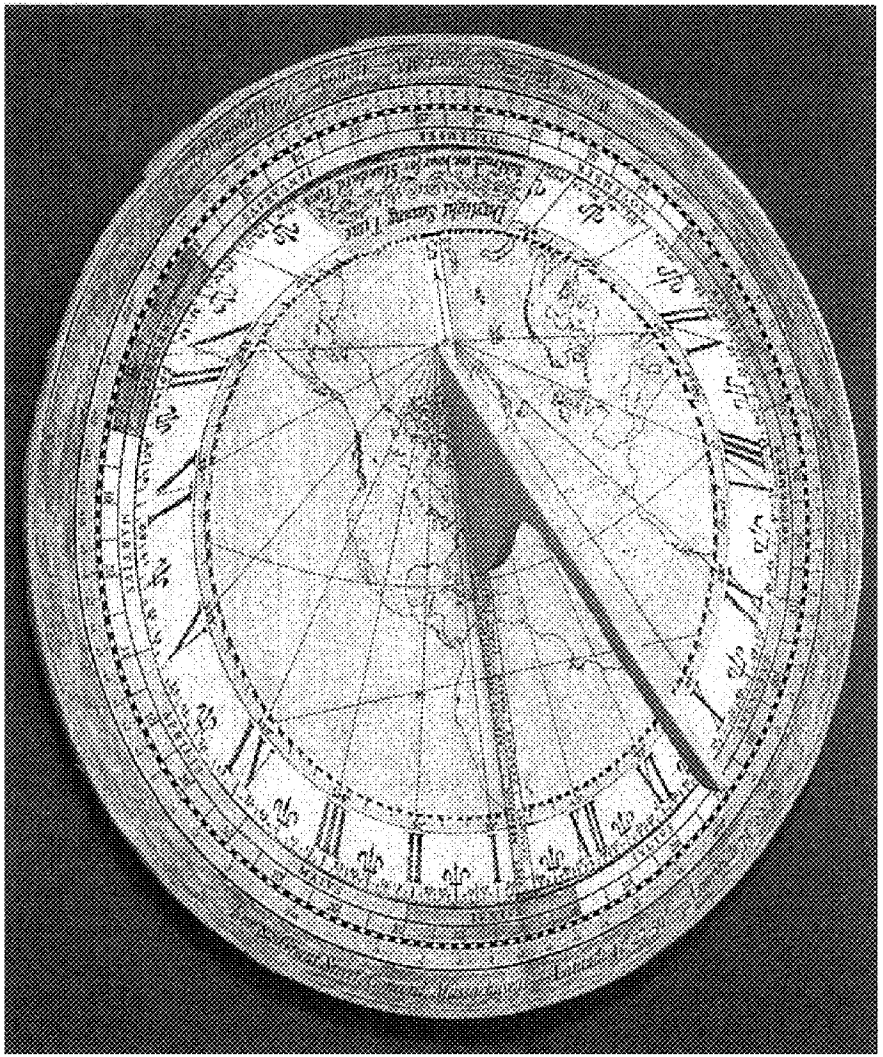
FIG. 4. shows isometrically a further embodiment.

Another embodiment of the present invention shown in FIG. 4 also uses a traditional form of gnomon and incorporates a scale to show the Sun's declination. It enables traditional colors to enhance the design, which could then be printed on porcelain and fired with a permanent glaze. There are problems with achieving the desired color, fragility of porcelain, and high cost of manufacturing each dial individually, but these can be solved on a custom basis for each single installation or class of like installations. The gnomon wire is preferably of about 0.020 in. diameter and made of a tough, corrosion resistant material, e.g. stainless steel or nitinol ($N_1$ –$T_1$ shape memory alloy).

The present invention automates the construction of the hour circle with the divisions of hours and minutes; designs an effective gnomon to avoid the problems of dividing the hour circle and map; and finds suitable methods of production and appropriate materials for every component part.

The invention includes a gnomonic projection map generated by a conversion software program such as Geocart and downloaded into a graphics software program such as Adobe Illustrator which can build the converted data into a layout of the sundial's hour circle with the precise divisions of hours and minutes corresponding with the longitude lines on the map. Because each instrument is designed for a specific location, the invention cannot be mass-produced. The wire gnomon is anchored to a pole (North Pole in FIG. 1) position on the map and the wire points to the axial point of the Heavens (i.e. close to Polaris) and is so anchored by an elevated support. (Southern axial point for a Southern Hemisphere location close to Southern Cross).

Figure 5:
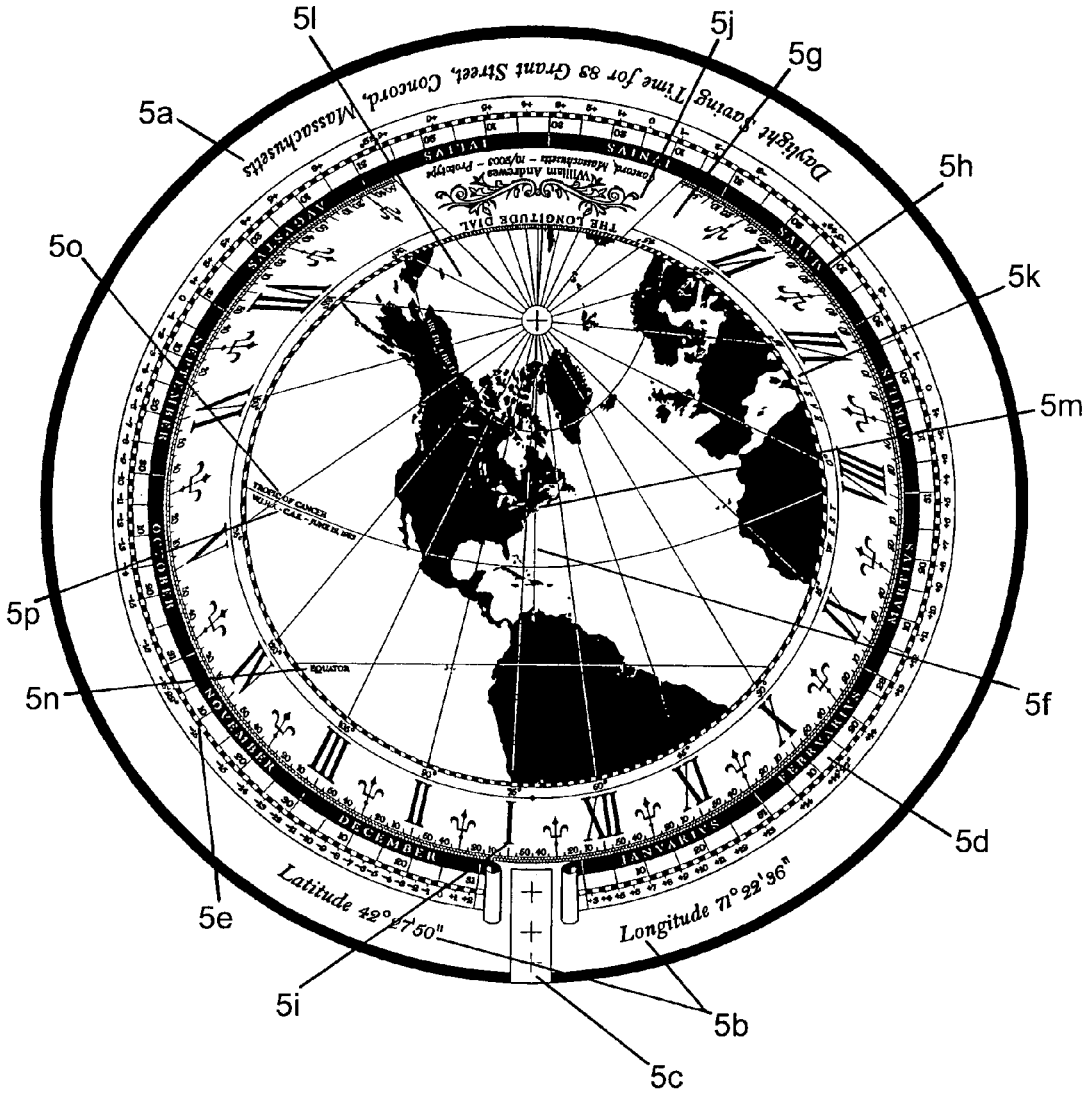
FIG. 5. shows the layout view of component parts of the sundial of the invention.

The details of all the component parts of the dial plate, illustrated in FIG. 5, are as follows:

In the outer ring (5*a*) an inscription requested by a user can be marked along with the latitudinal and longitudinal coordinates (5*b*), which are positioned on either side of the gnomon post. (5*c*).

The circle inside this gives the equation of time (5*d*), which shows the number of minutes that must be added or subtracted to convert solar time to standard time. These are aligned with the date to which they correspond on the calendar ring. Making this adjustment is simple. For example (5*e*), on November 11, the difference shown is "–16", so sixteen minutes must be subtracted from the time shown on the sundial: therefore, if the gnomon's shadow indicates 11:33 a.m., the correct standard time would be 11:17 a.m.

The equation of time ring also provides a quick and simple method of aligning this instrument precisely on its North-South axis. For this purpose, the process of using the equation table is reversed, because instead of using the sundial to determine clock time, clock time is used to set the sundial. The signs of addition or subtraction must therefore be transposed. To set the dial correctly on November 11 at 11:17 a.m. clock time, the corresponding sixteen minutes discrepancy between sun time and clock time must now be added instead of subtracted: thus the dial is rotated until the gnomon's shadow aligns with 11:33 a.m. The surface of the sundial must, of course, be set precisely on a horizontal plane beforehand. While the fixed models of this dial ("garden" and "monumental") will need no adjustment, a portable "terrace" model would need to be leveled correctly adjusting the three screw feet under the dial plate until the spirit level (provided) is centered. When oriented and leveled, the meridian running down the center of the dial (5*f*) will be aligned on a North-South axis and the gnomon will point to the axial point of the heavens, (i.e. Polaris).

Inside the equation of time ring is the hour circle, with the divisions of hours and minutes (5*g*). Each hour and ten-minute interval is numbered, and, for clarity, the minutes are inscribed alternately in two bands (5*h*). The hours and minutes are positioned automatically in the computer program so that the shadow of the gnomon will indicate (with the necessary adjustment for the equation of time) the correct time to the nearest minute for the dial's location. Unlike most sundials, the hour numerals of the sundial are adjusted (whenever appropriate) for Daylight Saving Time, which is used between April and October when sundials are of greatest use (5*i*). Note that the numerals have been skewed so that the vertical lines all point toward the Earth's axial point on the map (North or South Pole), while their horizontal lines remain concentric with the center point of the map. The program allows the design to be created in a graphics program, such as Adobe Illustrator, in a straight line: after the desired coordinates have been entered, the hour numerals are transformed from a straight line into a circle that corresponds with the lines of longitude on the map.

General information about the dial is inscribed in the area of the hour circle after sunset and before sunrise (5*j*). In addition to name and maker information, this gives the date of manufacture and the serial number of the instrument. The lines dividing this area from the hour circle mark the time of sunrise and sunset on the longest day of the year.

On the outer edge of the map is a scale showing the map's orientation in degrees of longitude East or West of the Prime (Greenwich) Meridian (5*k*). Each mark of 15° from the Prime Meridian is numbered, and these points align with a specific hour in the hour circle.

The gnomonic projection map occupies the central area of the dial (5*l*), with the continents, islands, lakes, oceans, and seas clearly defined. The place for which the dial is made is located right in the middle (5*m*). A dotted line representing its meridian runs through the center of the dial (5*f*): when the gnomon's shadow crosses this line, it will indicate that the Sun has reached its highest point in the sky for that day. The map is also marked with its appropriate astronomical lines: this example is made for the Northern hemisphere and thus shows the Equator, the Tropic of Cancer, and the Arctic Circle. The shadow of the bead on the gnomon (see 1*d*) will follow the straight line of the Equator (5*n*) at the equinoxes (March 21 and September 22) and the curved line of the Tropic of Cancer (5*o*) at the Summer Solstice (June 21). The variation in the Sun's declination allows special occasions (such as weddings, anniversaries, and birthdays) to be identified on the map as well (5*p*). These, however, are sometimes limited by the date they occur. For the latitude of this dial, much of the area near the Tropic of Capricorn where the Sun is overhead in mid-winter is not visible on this map. The process of automating the design of this dial, which makes it viable for manufacture on a commercial basis, is as follows: The gnomonic projection map, created by Geocart, is downloaded to Adobe Illustrator. The design of the hour circle is laid out in a straight line. A computer program, commissioned especially for this particular purpose, takes this line and transforms it into a circle. Before so doing, the same latitude and longitude coordinates as those specified for the map are entered on the transforming device's palette along with the local deviation, which controls adjustments for the desired type of standard time (Daylight Saving, etc.) and time zone. With these values established, when the straight line is transformed into a circle, the vertical lines of the degrees, hours, and minutes will all point toward the North (or South) Pole, while the horizontal lines will remain concentric with the center of the circle (5*g*, 5*h*, 5*i* and 5*k*). The gnomonic projection map (5*l*) is then incorporated inside the hour circle, its lines of longitude aligned with the hour markers. Other embodiments of the design, such as the equation of time circle (5*d*), the general informational plaque (5*j*) and the inscription ring (5*a*/5*b*), are then applied.

To enable commercial viability, i.e. using reasonably-priced manufacturing method and materials, the following criteria apply:

A. high precision in the transfer of the design;

B. elegance and a high intrinsic value in the dial's appearance;

C. durability to withstand erosion and decay by the elements for hundreds of years; and D. production at a reasonable cost;

Certain basic techniques are recommended or preferred but not limiting of the present invention's scope:

1. traditional methods of hand engraving on brass are avoided because of complexity;
2. machine engraving on brass, silver, or other material is used[1]; and
3. an igneous or metamorphic rock type of material, or the like, can accept laser etched designs with high precision at a reasonable cost.

[1] Printing the design on porcelain-enameled steel is possible, but its appearance does not have an intrinsic value, and it is an expensive process for one-off production. The design can be printed on porcelain, but the special considerations of this material, including its fragility in attaching the gnomon and other parts, make it impractical for widespread use.

Igneous rock materials have seldom been used for sundials, because they are very hard to work with traditional techniques. The laser-etching technology developed for the growing tombstone industry is capable of delivering high-resolution graphics. Although a variety of colors may be employed, the preferred type currently selected for the invention is black rock called gabbro with a very fine grain. Although black may seem like an unusual color for an instrument that has to show the dark shadow of a gnomon, this highly polished material reflects the sky and thus creates a lighter appearance on its surface. The polished black rock turns light gray when etched, and the etched areas provide a good contrast and a clearer reading of the gnomon's shadow. The rock material requires minimal finish or preservation treatment after the etching has been done.

The Gnomon

Figure 6:
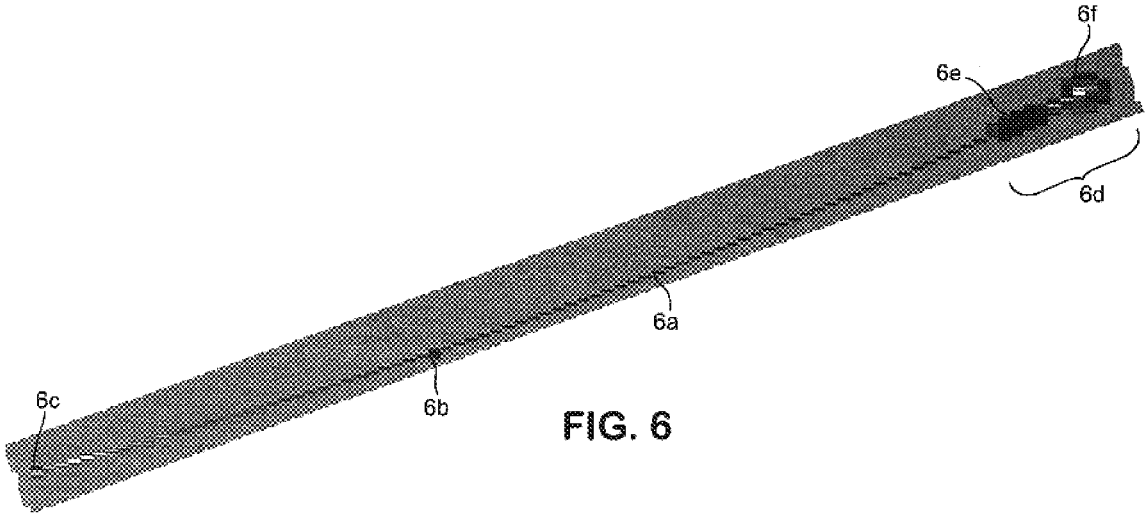
FIG. 6. is a photographic copy of component parts of the gnomon wire assembly.
Figure 7:
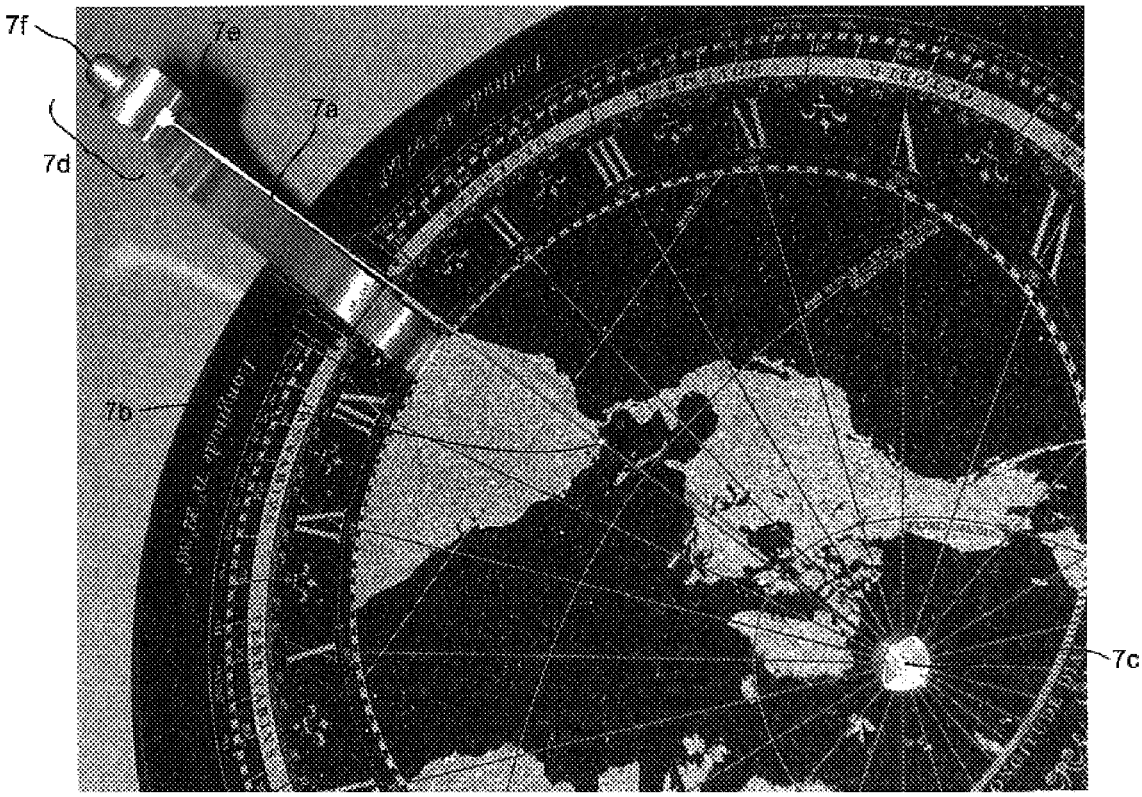
FIG. 7. is a photographic copy of the gnomon wire assembly of FIG. 6 in position, supported by its brackets.

Another part of the invention is an innovative form of the gnomon, the device that casts the Sun's shadow. A standard form of thick brass gnomon is unsuitable because it compromises the layout of the map and the hour circle. Thus, in order to make the shadow as thin as possible, a special form of wire gnomon was implemented. Sundials employing a string gnomon are well known, but these were used on small portable dials. The gnomon of the present invention has been designed for outdoor use. As illustrated in FIGS. 6 and 7, the wire (6*a*, 7*a*) is secured at both ends with brass mounts anchored to the dial plate. The brass bead in the center (6*b*, 7*b*) casts a shadow that shows where the Sun is directly overhead on Earth. While the lower support (6*c*, 7*c*) is positioned at the North (or South) Pole on the map (the Earth's axial point), the upper end (6*d*, 7*d*) secures the wire at an angle with the dial plate corresponding precisely with the dial's latitude. The position of the North (or South) Pole on the map (where the hole to anchor the lower gnomon support is drilled in the base) will vary with latitude. The holes drilled to secure the gnomon's upper support post (see FIG. 5*c*) remain the same for every dial, but the height of the post changes according to the dial's latitude. The gnomon wire has been designed so that it can easily be replaced if it gets damaged and can be made taut in case any variation in temperature causes it to become loose due to expansion or contraction in the metal parts. A brass bead riveted to its lower end (6*c*, 7*c*) retains the gnomon wire in a slot in the lower support, while its upper end is held fast with screws inside an elongated square (6*e*, 7*e*). This square, which slides in a square hole in the gnomon post, has a threaded extension with a spherical knob (6*f*, 7*f*) that can be tightened to increase the tension of the wire or loosened to remove the wire gnomon assembly by taking the lower bead out of its slot in the lower support.

On the gnomon wire directly above the center of the dial (the location of the place for which the dial is made) is the small brass bead that shows the Sun's overhead position on the map (6*b*, 7*b*).

Figure 8:
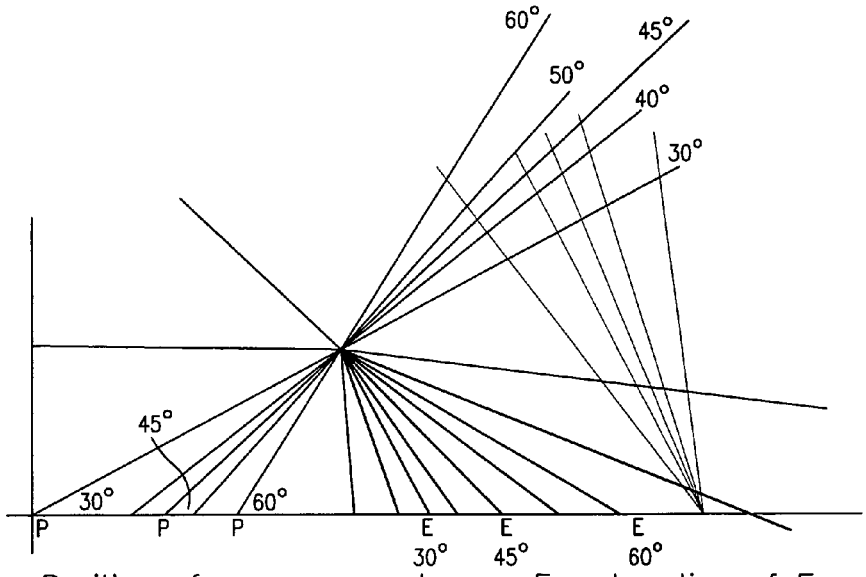
FIG. 8. is a schematic drawing illustrating that the gnomon bead above the center of the dial is a universal point for all the sundial embodiments.

It has also been discovered that although the angle of the gnomon varies with latitude, the location of this bead remains constant. Thus, as shown in FIG. 8, the bead's position represents a universal point for all horizontal sundials.

Although this universal point could not be used to simplify the design of the gnomon (because it would not be sufficiently sturdy), it serves as the axial point of the assembly being designed to test each dial when completed.

Finish

While the plate, if made from a rock type of material, will not require any protective coating after laser etching, any brass parts will need such coating. Those made for a portable "terrace" version of this dial can be gilded and coated with a durable finish similar to that used on gilded faucets. Those made for "garden" and "monumental' models can be weathered artificially to a rich verdigris color and treated with a wax to preserve their appearance.

Figure 9:
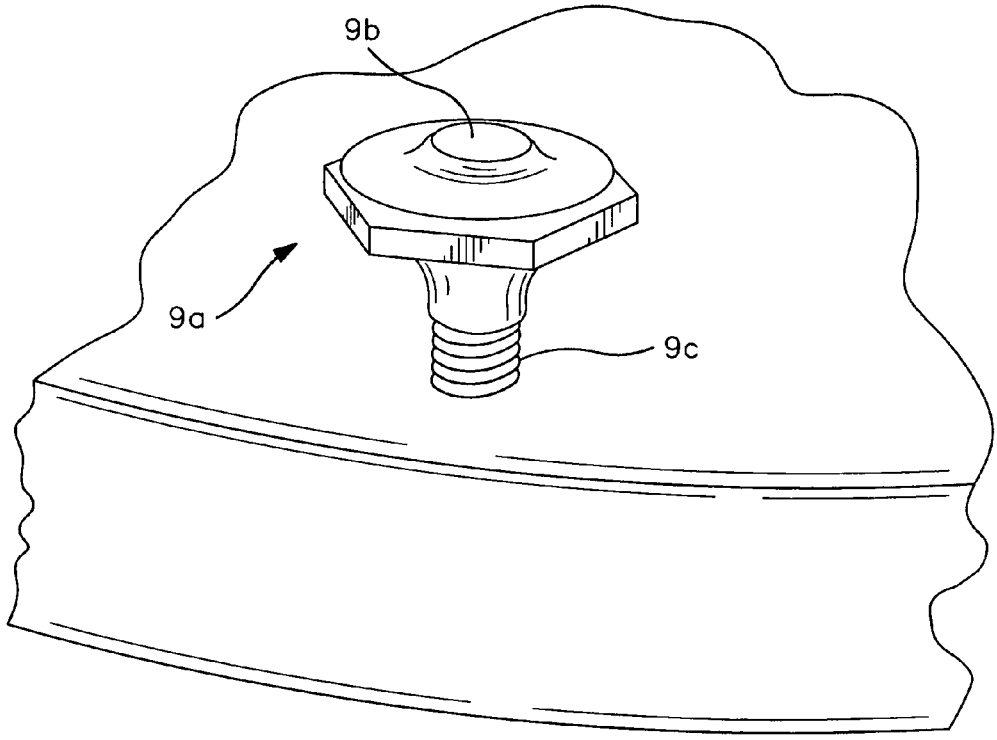
FIG. 9. isometrically shows detail of one of the three adjustable feet used on the portable "terrace" model.

Variations:

A "terrace" or portable version, a little over twelve inches in diameter, can be furnished with a presentation box in which it may be shipped and later stored when not in use. The box can also house a descriptive booklet and a certificate. For leveling, this model can have three screw feet designed to be easily adjusted beneath the dial plate. FIG. 9 depicts one of the feet (9*a*), the base of which has a countersunk felt pad (9*b*) to avoid scratching delicate surfaces. The bolts (9*c*) on which each foot is threaded are also used as the anchor points for attaching a "garden" dial to its pedestal.

The "garden" and "monumental" dials, with diameters of 22" and 47" respectively, can be mounted on a pedestal or other decorative, man-made, or natural feature. They can be supplied with a black anodized aluminum plate, which is bolted to the pedestal. Three rods secured to the underside dial of the dial plate are locked into holes in the aluminum plate with three screws in its outer edge.

For a more sculptural version of the invention intended for public spaces where larger size is necessary, the dials can be made out of a large piece of rock or similar durable material and the dial plate can be etched directly into the leveled, polished surface.

Each dial can be provided with a certificate of authenticity, specifying all the relevant details concerning its origins and ownership (provenance) and an illustrated booklet describing the origins of our system of time measurement, the history of gnomonic projection and the sundials, and a detailed explanation of all the features of the invention. If the box described in par. [0029] proves to be too expensive, the cover of this booklet may be designed to accommodate the certificate.

The invention can be made for the specific location of a customer or as a standard model for a particular town. The value of a degree of longitude, which is 60 nautical miles at the equator and zero at the poles, decreases as the latitude increases. At latitude 42° (Boston), it is just under 45 miles, and at 51° 30' (London), it is about 37 miles. Therefore, since the Earth rotates one degree every four minutes, one minute of time represents movement through a distance of about 11.25 miles at 42° and 9.25 miles at 51° 30'. Thus, the radii for keeping time to within one minute will be about 5.6 miles for Boston and 4.6 for London.

Figure 10:
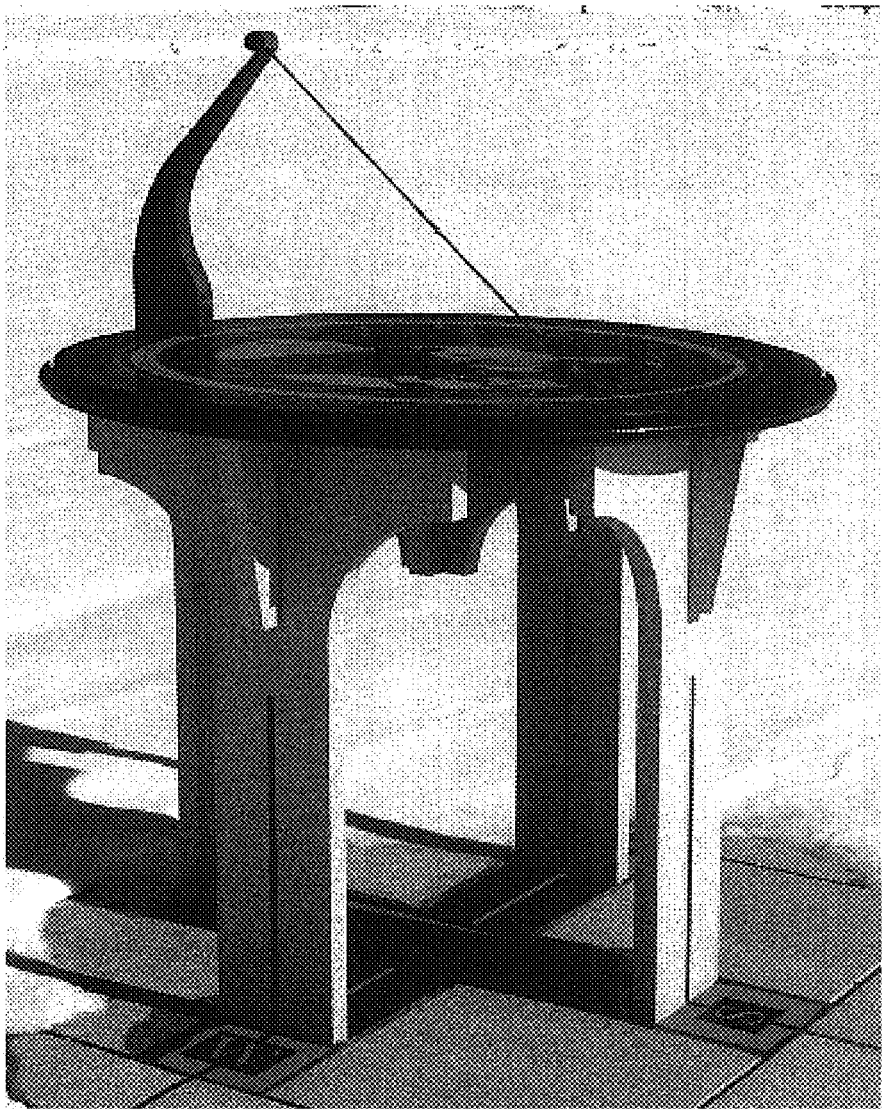
FIG. 10 is a photograph of a fixed "monumental" version of the sundial mounted on a four legged pedestal structure.

FIG. 10 shows a sundial mounted on a pedestal structure with four legs having slits oriented North-South-East-West and allowing the Sun's light to shine on North, South, East, West pre-marked lines on the gabbo and granite base when the Sun is in the appropriate position. The North-South line below is marked with dates and Zodiac signs and coordinated to Southern slit height so that the Sun's declination (reasonably dependent) casts a beam of light through the slit showing current date and the Sun's position in the Zodiac. This provides a supplemental display.

Figure 1:
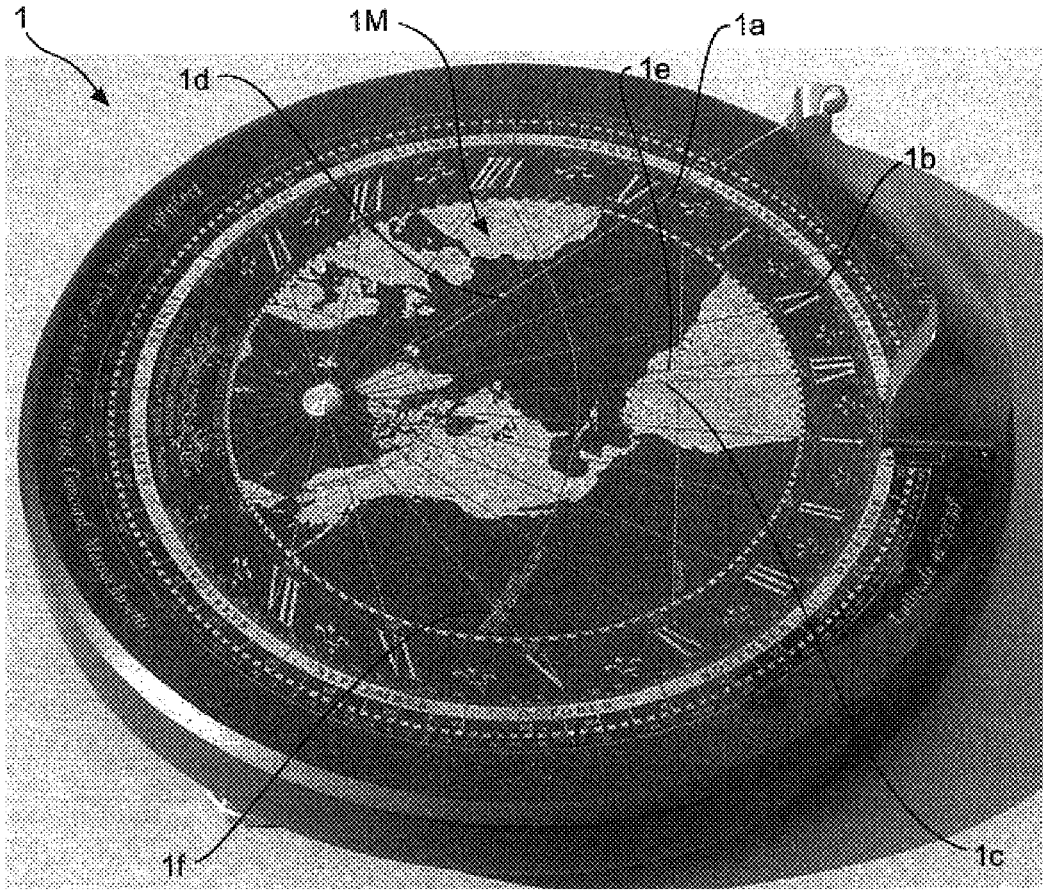
FIG. 1. Shows the general concept of the present invention of a longitude dial sundial via an illustrative embodiment (discussed above)
Figure 11:
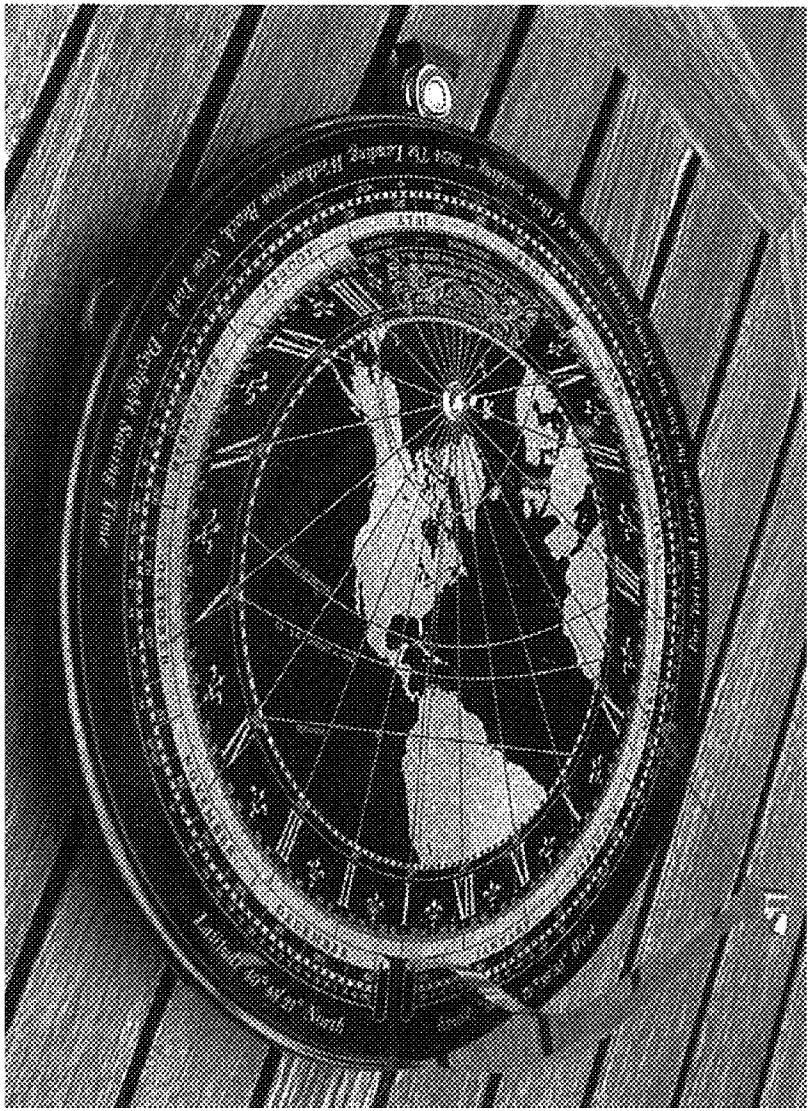
FIG. 11 is the portable "terrace" version of the previous figures mountable on a table or bench surface.

FIG. 11 has a dial similar to FIG. 1 and has three adjustable feet and is used with a spirit level to level the dial on a bench, table or the like. The spirit level is housed in a storage compartment beneath the dial plate.

Figure 12:
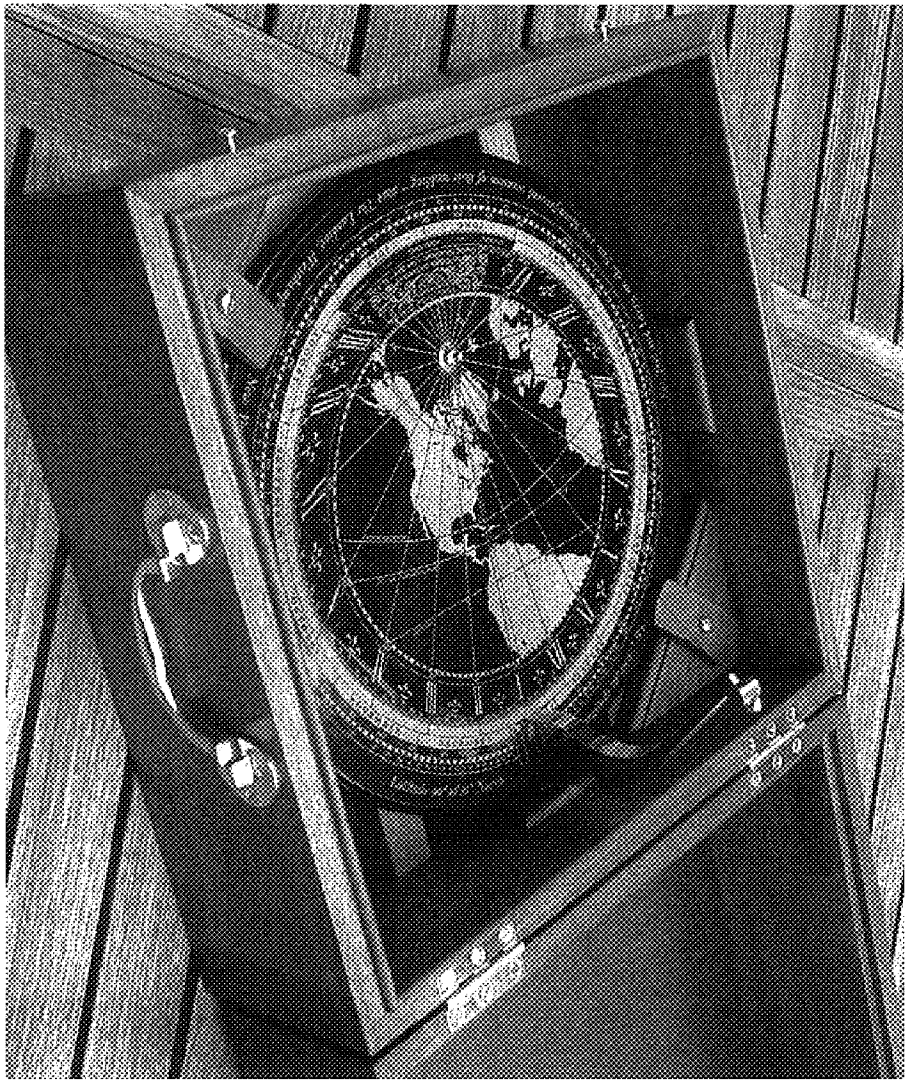
FIG. 12 is the portable "terrace" in its presentation/storage base.

FIG. 12 shows a boxed version of the portable dial. The box is used for shipping, presentation and storage.

Figure 13:
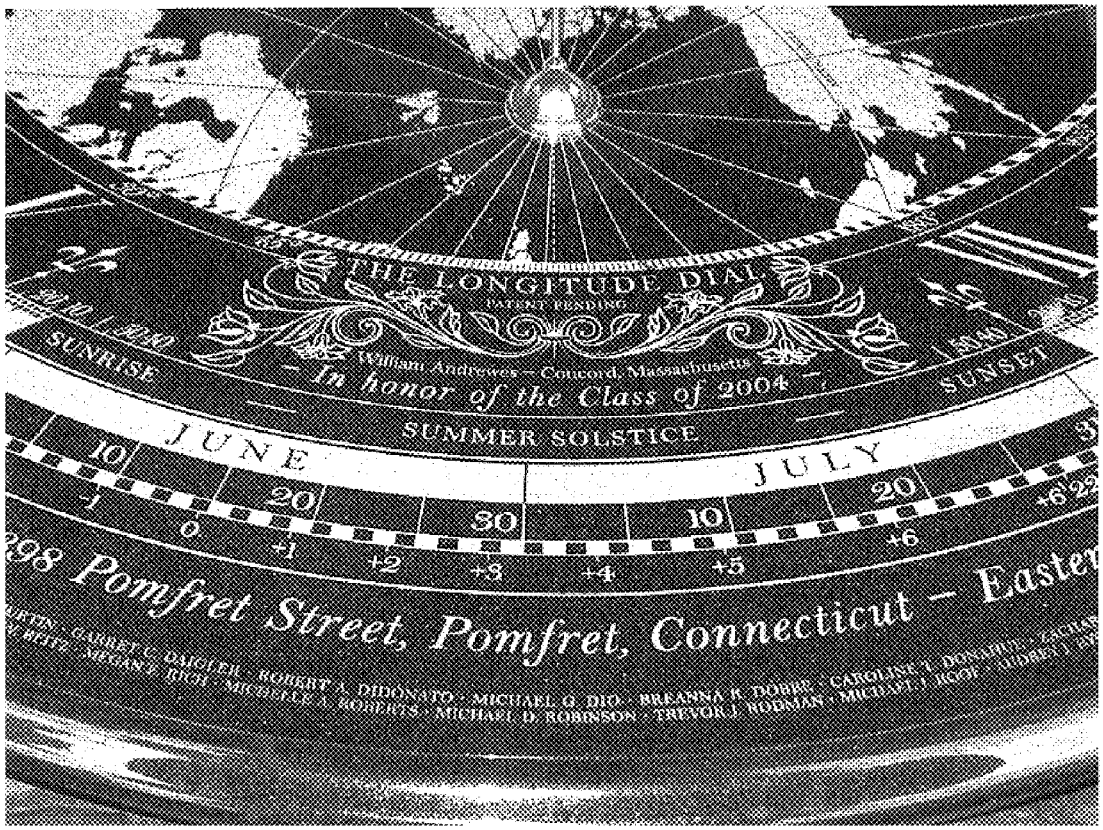
FIG. 13 is a detail of the dial in FIG. 10 as customized for a particular installation.

FIG. 13 is an expansion showing details of information on any such dial—showing, in this instance, a portion of the equation of time scale (−1, 0, +1. etc.) for converting solar time to standard time on a given date (June 10, June 15, June 19, etc.), sunrise and sunset times for the given location at the Summer Solstice, degrees longitude East or West of the Greenwich (prime) meridian and special dedication inscriptions—all laser etched.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A horizontal sundial apparatus for finding time based on shadow to the nearest minute at a given location comprising:

(a) means providing a horizontal surface which is reflective and hard but etchable or inscribable and has a gnomonic projection map centered on the location for which it is made and having a time scale and equation of time scale, (b) means providing a wire gnomon stretched above the gnomonic projection map between a map-pole position and an elevated position at an angle corresponding to latitude of the sundial's given location to point to the Northern axial point of the Heavens a Northern Hemisphere location or Southern Cross for a location South of the Equator and coordinated with the map to provide a shadow of the wire that indicates noon on the map, and (c) a further indicator, formed as a bead along the length of the wire gnomon arranged at the universal point and marking by its shadow on the map, where the sun is directly overhead on a given date.

2. The sundial of claim 1 with one or more indicators of special occasion anniversary, birthday, etc. marked on the map between the Tropics as a line of latitude that the shadow of the gnomon's bead will target on the appropriate date.

3. The sundial of claim 1 wherein said horizontal surface has a face of polished black igneous rock (micro-fine gabbro or basalt.

4. The sundial of claim 3 wherein the rock is etched with the map, time scale and other information.

5. The sundial of claim 4 with one or more indicators of special occasion anniversary, birthday, etc. marked on the map between the Tropics as a line of latitude that the shadow of the gnomon's bead will target on the appropriate date.

6. The sundial of claim 1 adapted for finding local standard time to the nearest minute that can be manufactured on a commercial basis with customization to various localities and comprising means for showing fine increments of time e.g. minutes that need to be added or subtracted to determine standard time from the time indicated by the gnomon's shadow.

7. The sundial of claim 1 in combination with means for adjusting wire tension when required by the expansion or contraction of the gnomon assembly parts or easily replaced when necessary.

8. A method of orienting the sundial of claim 1 precisely on a North-South axis using an accurate timekeeper for calibration by orienting the dial face that is held horizontal to align with time shown by the timekeeper.

9. The sundial of claim 1 with the gnomonic projection map as generated by automated that is computerized custom machinery the hour and minute markers to the map projection for the given location.

10. The sundial of claim 9 with nominal adjustment to the given location with the horizontal lines of numerals concentric with the center and vertical lines of the numerals all pointing radially inward to the polar position on the map.

11. The sundial of claim 1 further comprising a pedestal with shadow casting features to show the date and Sun's position in the zodiac.

* * * * *